United States Patent [19]

Landsness

[11] 4,256,051

[45] Mar. 17, 1981

[54] DUSTING APPARATUS

[75] Inventor: Clifford A. Landsness, Akron, Ohio

[73] Assignee: The B. F. Goodrich Company, Akron, Ohio

[21] Appl. No.: 73,165

[22] Filed: Sep. 6, 1979

[51] Int. Cl.[3] ..... B05C 3/09; B05C 11/02

[52] U.S. Cl. ..... 118/107; 118/114; 118/687

[58] Field of Search ..... 118/18, 107, 109-112, 118/114-117, 320, 416, 668, 676, 686, 687; 427/368

[56] References Cited

U.S. PATENT DOCUMENTS

| | | | |
|---|---|---|---|
| 570,538 | 11/1896 | Burns | 118/107 |
| 1,672,737 | 6/1928 | Skinner | 118/107 X |
| 1,983,684 | 12/1934 | Strong | 118/107 X |
| 2,487,196 | 11/1949 | Sternad et al. | 118/320 X |
| 2,579,737 | 12/1907 | Giordano, Jr. | 118/320 X |
| 2,760,550 | 8/1956 | Kimes | 118/107 X |

*Primary Examiner*—Morris Kaplan

*Attorney, Agent, or Firm*—Joseph Januszkiewicz

[57] ABSTRACT

A bead dusting apparatus for applying talc to a circular tire bead utilizing a housing with a guideway therethrough. An entrance ramp feeds beads seriation into the housing where a first pair of rollers support and rotate each bead through a tank containing talc. Each bead is then indexed into a second portion of the housing where a second pair of rollers supports and rotates the beads between opposed brushes to remove excess talc. The dusted beads are discharged by a bead indexing mean.

2 Claims, 4 Drawing Figures

DUSTING APPARATUS

BACKGROUND OF THE INVENTION

This invention relates to an apparatus for applying dust such as a powdered lubricant to the surface of rubber articles.

In the manufacture of articles of rubber or plastic materials it is often times necessary to apply a coating of dust such as talc, powdered mica, soapstone or starch to the adhesive surfaces of the materials to prevent the material from adhering to similar material with which it comes in contact. Particularly, in the manufacture of tires this is very important, otherwise the various components of the tires such as beads, flipper materials, treads, sidewall rubber and related parts must be kept separated to prevent sticking. In the manufacture of beads, provision is made to space the formed beads on a storage rack to prevent their sticking together as they are prepared for subsequent use at the tire forming or building machine. In the present invention, a new and improved bead dusting apparatus is located adjacent to the bead manufacturing machine to dust the formed bead to permit stacking and handling for subsequent use without concern as to adhesion between adjacent beads. In addition, with the proper dusting as taught by this invention, the placement of the bead onto the tire carcass and during the subsequent shaping of the tire; the material surrounding the bead will be permitted to rotate around the bead during such shaping operation.

SUMMARY OF THE INVENTION

The present invention contemplates a bead dusting apparatus for the dusting of tire beads automatically as they are removed from a bead forming machine. The bead duster rolls the formed tire bead through a dusting apparatus which applies the dust to the bead at a first station and thence brushes the excess dust from the bead at a second station to remove the excess therefrom. The bead is then ejected and moved into position for stacking. The bead dusting apparatus is enclosed by a housing to prevent escape of the dusting powder into the work room protecting the health of the workmen and effecting a saving of the bead dusting powder.

DETAILED DESCRIPTION

Figure 1:
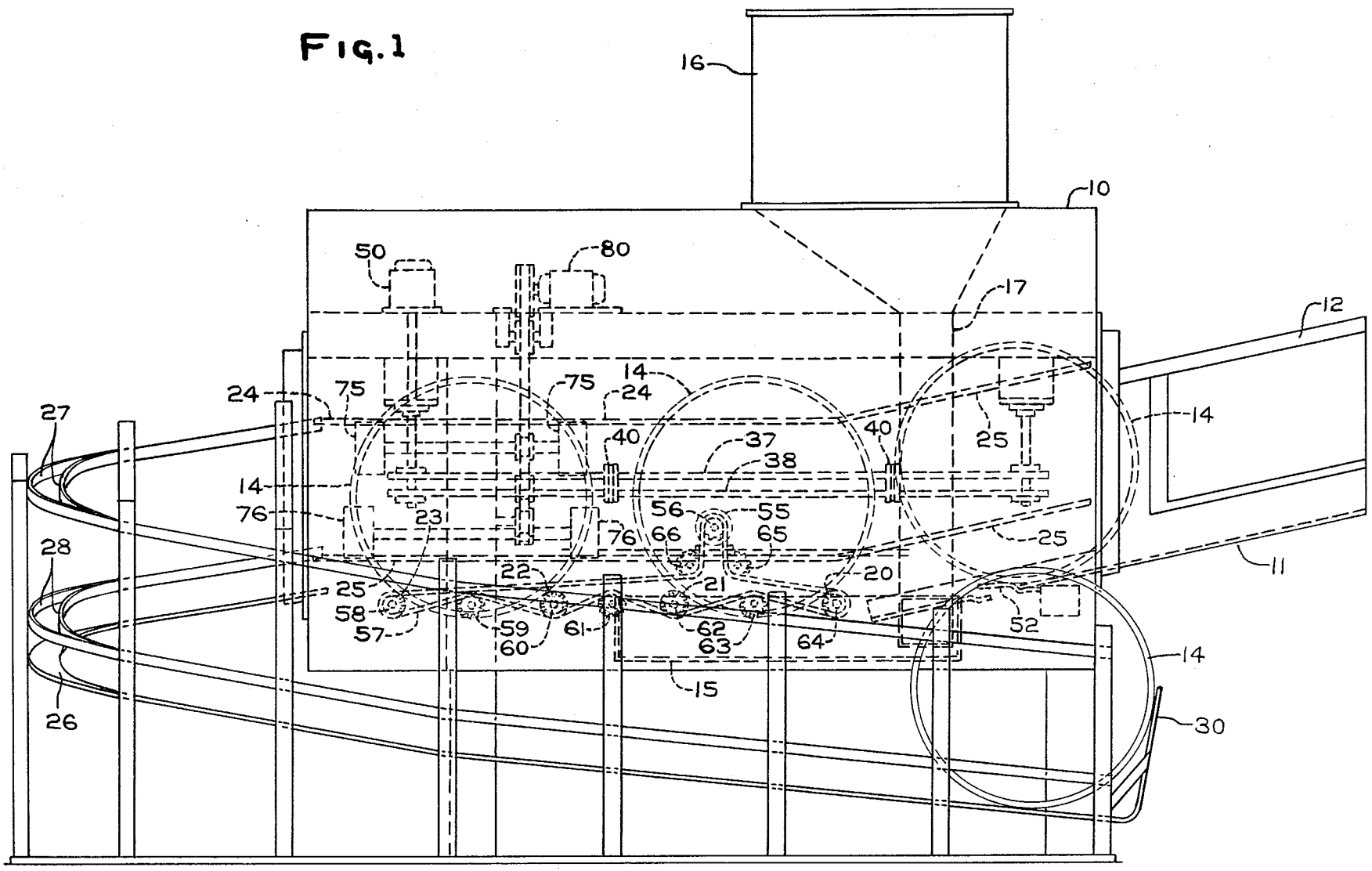
FIG. 1 is a front view of the bead dusting apparatus.
Figure 2:
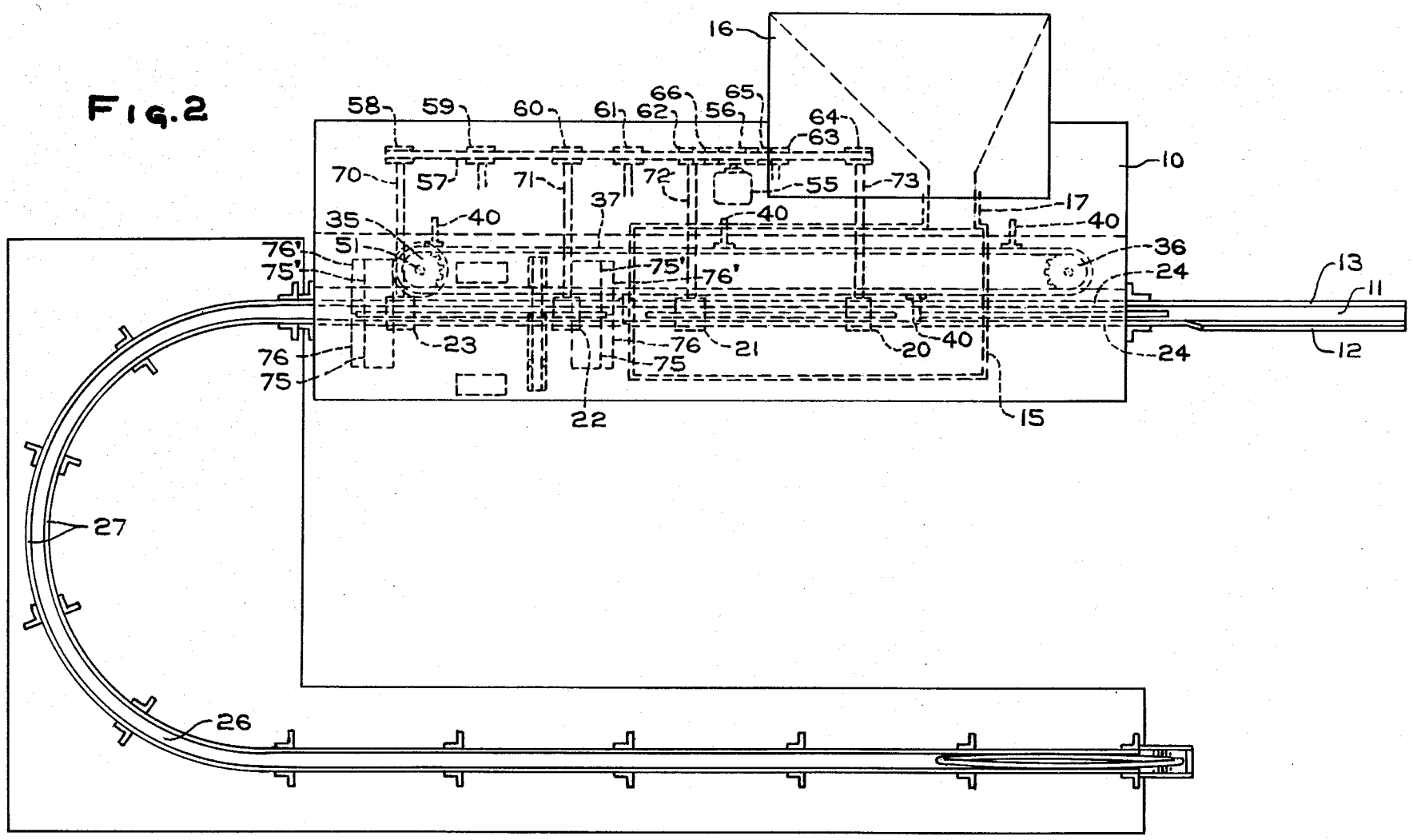
FIG. 2 is a plan view of the bead dusting apparatus.
Figure 4:
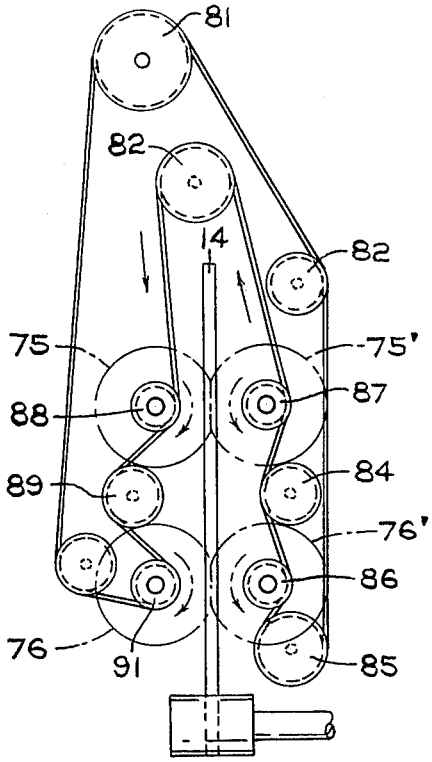
FIG. 4 is a side elevational view of the drive means for the bead dusting machine.
Figure 3:
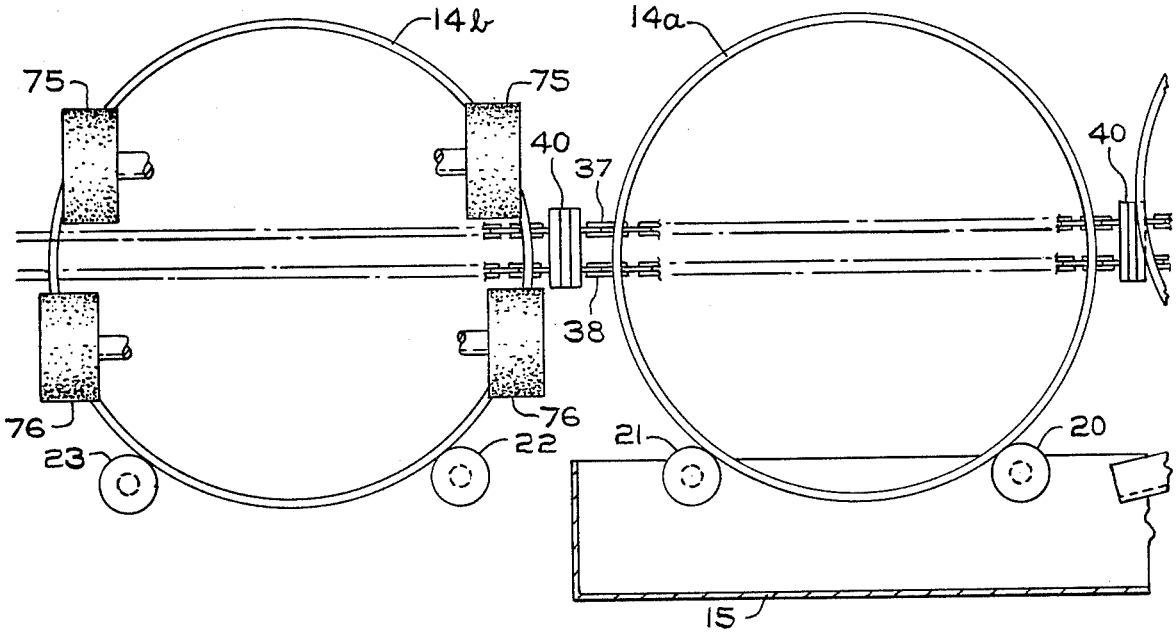
FIG. 3 is an enlarged fragmentary first elevational view of a pair of beads being rotated and the respective brushes operating on the bead.

Referring now to the drawings, wherein like reference numerals designate like or corresponding parts throughout the several views, there is shown FIGS. 1 and 2 a housing 10 suitably supported. One side of the housing 10 has an opening with a guideway 11 extending thereinto with adjacent guiderails 12 and 13 to guide a circular bead 14 into the housing. Located within the lower bottom portion of the housing 10 is a supply receptacle, tank or box like structure 15 which has talc or some similar rubber lubricant. An elevated hopper 16 secured to the top portion of housing 10 contains a supply of talc which is gravity fed to the talc supply receptacle via supply pipe 17.

A plurality of cooperative rollers 20, 21, 22, and 23 are operative in pairs to support for rotation the beads 14*a* and 14*b* as shown in FIG. 1. Pairs of vertically spaced guides 24 and 25 extend generally horizontally through the housing 10 except at the one end, wherein the pairs of guides 24 and 25 are inclined upwardly to be in alignment with guiderails 12 and 13. Such spaced guides 24 and 25 cooperate with pairs of rollers 20, 21, 22, and 23 to support and guide the beads through the dusting apparatus as to be described. The other side of housing 10 has an opening in alignment with the guide rails or guides 24 and 25 to facilitate the discharge of the beads from the housing 10. An inclined guideway 26 extends from such opening on the other side of housing 10 to discharge the dusted or coated beads 14. Vertically spaced pairs of guides 27 and 28 (FIG. 1) extend from such opening on the other side of housing 10 and cooperate with a lower guideway 26 to facilitate the removal of beads 14 from the dusting apparatus. A vertically extending strip or bar 30 which may be an extension of guideway 26 is located at the one end portion of guideway 26 to act as a stop for the dicharged beads 14.

To facilitate the movement of the beads 14 through the dusting apparatus, pairs of sprocket 35 and 36 are suitably journaled in the housing 10. A pair of interconnected chains 37 and 38 are suitably trained about pairs of sprockets 35 and 36 respectively. Chains 37 and 38 have projections or fingers 40 suitably connected thereto for advancing the beads 14 along rollers 20, 21, 22, and 23 and for discharging the beads 14 from the housing 10 as such chains are indexed or moved a predetermined distance. A motor 50 (FIG. 1) mounted on the upper portion of housing 10 is connected via a shaft 51 to sprocket 35 for indexing such sprocket 35. A suitable pressure switch 52 actuated by a bead 14 rolling down guideway 11 is operative to energize motor 50 momentarily to advance a bead one position through the bead duster apparatus in cooperation with the plural spaced fingers 40.

A motor 55 (FIG. 2) is suitably mounted within housing 10 to drive sprocket 56. A chain 57 is suitably connected to such sprocket 56 and suitably trained about sprockets 58 through 66 and is operative to rotate the rollers 20 through 23 and the bead rings resting thereon for dusting. Sprocket 58 is connected to roller 23 via shaft 70, sprocket 60 is connected to roller 22 via shaft 71, sprocket 62 is connected to roller 21 via shaft 72 while sprocket 64 is connected to roller 20 via shaft 73.

Mounted within housing 10 and forwardly of the beads 14 resting on the rollers 22 and 23 are a pair of upper brushes 75 and a pair of lower brushes 76. Mounted directly behind brushes 75 and 76 are pairs of brushes 75' and 76' respectively which rotate in opposite direction to remove the loose talc or lubricant from the bead 14 that is positioned between such brushes and resting on rollers 22 and 23. The brushes 75, 75', 76, and 76' are rotated by a motor 80 driving sprocket 81 which in turn rotates sprockets 82 through 91 with sprockets 86, 87, 88, and 91 rotating the respective brushes.

In the operation of the described apparatus, the operator on completing the fabrication of a bead from tacky rubber materials, places the bead onto a guideway or ramp 11 such that the bead rolls down the guideway and engages trip switch 52, which in turn energizes motor 50. Rotation of sprocket 35 by such motor 50 indexes chain 37, 38, along with fingers 40 which thereby carries the bead 14 entering the bead dusting apparatus and deposits the bead ring 14 on the first set of rollers 20 and 21 for rotation by such rollers in the dusting receptacle 15. Upon completion of another bead ring by the operator and by placing such bead ring onto guideway 11, the bead ring rolls down the guideway to actuate the switch 52 on guideway 11 which will actuate motor 50 for another indexing action by chains 37 and 38 which in turn will move the bead ring located between rollers 20 and 21 into position on the second set of rollers 22 and 23 while the new bead ring is deposited on the first set of rollers 20 and 21. While the newly deposited bead 14 on rollers 20 and 21 has dust or talc applied to it, the bead ring on the second set of rollers 22 and 23 is being rotated while brushes 75, 75', 76, and 76' brush the excess talc therefrom. Upon completion of another tack bead ring by the operator and upon placing it on the guideway 11, such bead will roll down the guideway 11 to actuate switch 52 initiating another indexing action. The bead ring on the rollers 22 and 23 will be ejected from the housing 10 of the bead dusting apparatus onto the guideway 26 for movement down such guideway until it comes to rest against stop 30. The bead ring resting on rollers 20 and 21 will be moved by the indexing chains 37, 38 and the index fingers 40 to rollers 22 and 23 for brushing by brushes 75, 75', 76, and 76'. The bead ring just deposited on the guideway 11 which actuates trip switch 52 is moved onto the first set of rollers 20 and 21 for dusting of the tacky surface thereof.

Various modifications are contemplated and may be resorted to by those skilled in the art without departing from the described invention, as hereinafter defined by the appended claims, as only a preferred embodiment thereof has been disclosed.

I claim:

1. A bead dusting apparatus for applying talc to circular bead rings, said apparatus having a housing for confining talc dusting powder, guideway means connected to said housing for feeding and discharging bead rings to and from said housing, two pairs of longitudinally spaced bead rollers in said housing operative to support a pair of spaced bead rings for rotation, guiderails located in said housing in alignment with said bead rollers and said guideway means to facilitate the movement of bead rings through said apparatus, drive means connected to said bead rollers to provide a positive drive for said bead rollers, a tank with dusting powder therein mounted in said housing and surrounding one pair of said bead rollers to dust bead rings as rotated by said one pair of rollers, brushes mounted in alignment with the other pair of said bead rollers operative to remove excess dust from said bead rings supported by said other pair of bead rollers, indexing means mounted in said housing and operative upon actuation to move bead rings from said one pair of bead rollers to said other pair of rollers and simultaneously operative to move bead rings from said other pair of rollers to said guideway means for discharging a bead ring therefrom, and actuating means mounted on said guideway means for actuating said indexing means in response to a bead ring on said guideway means for feeding bead rings to said housing.

2. A bead dusting apparatus for applying a talc to a circular tire bead having a housing for confining the talc dusting powder, guideway means connected to said housing for feeding and discharging bead rings to and from said housing, two pairs of longitudinally spaced bead rollers in said housing operative to support a pair of spaced bead rings for rotation, guiderails in alignment with said bead rollers and said guideway means to facilitate the movement of bead rings through said bead dusting apparatus, drive means connected to said bead rollers to provide a positive drive for said bead rollers, a dusting tank mounted in said housing surrounding at least one pair of said bead rollers to provide a receptacle through which bead rings rotate to dust bead rings supported and rotated by said one pair of bead rollers, a pair of scrubbing brushes in said housing mounted in alignment with said bead rollers and on opposite sides of said bead rings to remove excess dust from said bead rings, said pairs of spaced bead rollers define at least two spaced operating stations, indexing means in said housing operative to move bead rings to and from said stations, and said indexing means includes an endless chain means with projecting fingers operative to move a predetermined distance upon actuation to move said bead rings through said dusting apparatus and from one station to the next station.

* * * * *